US005980109A

United States Patent [19]

Wan

[11] Patent Number: 5,980,109

[45] Date of Patent: Nov. 9, 1999

[54] SELF-TIED GARBAGE BAG

[76] Inventor: Hsueh-Yu Wan, No. 16, Lane 151, Sec. 3, Chang Ho St., Tainan, Taiwan

[21] Appl. No.: 09/288,704

[22] Filed: Apr. 9, 1999

Related U.S. Application Data

[63] Continuation-in-part of application No. 09/004,026, Jan. 7, 1998, abandoned.

[51] Int. Cl.[6] ..... B65D 33/28

[52] U.S. Cl. ..... 383/77

[58] Field of Search ..... 383/77, 71

[56] References Cited

U.S. PATENT DOCUMENTS

| | | | |
|---|---|---|---|
| 3,217,971 | 11/1965 | Shvetz | 383/77 X |
| 3,664,575 | 5/1972 | Lake | 383/77 X |
| 4,624,365 | 11/1986 | Derdyk | 383/77 X |
| 5,407,419 | 4/1995 | Kelly et al. | 383/77 X |

*Primary Examiner*—Jes F. Pascua
*Attorney, Agent, or Firm*—Rosenberg, Klein & Lee

[57] ABSTRACT

A self-tied garbage bag includes a pair of walls united along their lower ends and sides to form a container which has a top with an opening, a bottom and pair of lateral edges. A bond strip extends at one or both lateral edges of the container between a lower point which is spaced from the bottom of the container and an upper point which is spaced from the top of the container. The lower point of the bond strip is in the form of a sharp tip. A tear line extends along the bond strip from the lower point to a division portion which is disposal in proximity to the upper point of the bond strip. This tear line, being ruptured, separates a tie strip from the bond strip, however, integrally joining the tie-strip to the container at a division portion. The container has a wider upper part extending above the bondstrip, a wider bottom part extending below the bond strip, and a narrower middle part extending between the upper and bottom parts of the container. A bond line or tear line may be formed and extending parallel to the low line between a lower point which is spaced from the bottom of the tear line and an upper point which is spaced from the top of the tear line to reinforce the tie-strip, or to extend the bond line in a transverse direction at one end of the tear lie to double the length of the tie-strip.

2 Claims, 8 Drawing Sheets

SELF-TIED GARBAGE BAG

The present invention is a CIP of a U.S. patent application Ser. No. 09/004,026, filed Jan. 7, 1998, now abandoned, and which relates to a self-tied garbage bag, and more particularly to a garbage bag having the line and bond line on the side portion forming a reinforced tie-strip or a doubled length of a tie-strip arranged on the main body of the bag for closing the top of the bag.

BACKGROUND OF THE INVENTION

1. Field of the Invention

The present invention is a CIP of a U.S. Patent Application No. 09/004,026, filed Jan. 7, 1998, now abandoned, and which relates to a self-tied garbage bag, and more particularly to a garbage bag having tear line and bond line on the side portion forming a reinforced tie-strip or a doubled length of a tie-strip arranged on the main body of the bag for closing the top of the bag.

2. Prior Art

Conventional plastic packing bags can be classified into two types: flat mouth bag and vest-style bar. In general, the flat mouth bags are used for inside packing, the vest-style bags used for outside packing. Typically, oversized mouth flat bags are used for containing garbage, even though over-consuming the plastic bags pollutes the environment. The mouth of a bag is closed to seal the garbage in the bag by tying a knot for preventing the odor of the garbage form emitting out. Two opposite rim sides of the mouth are gripped to the two strips, which are tied together into a knot, to seal the bag. This way, the utilization ratio of the bag is limited to 65%–80%. If the garbage bag is over-filled, tying the knot becomes difficult, and even if the knot has been tied, it will be unlocked easily.

For overcoming the above-mentioned shortcomings, several modified garbage bags were manufactured as shown in FIG. 6 to FIG. 8. As shown in FIG. 6 and FIG. 7, the bag is the flat mouth bag 10 with a flat mouth 12 and a tie-wire 11 pre-set on the outside of the bag near the mouth 12. By means of the tie-wire 11 the mouth 12 of the bag 10 can be tightened up. The bag shown in FIG. 8, pre-hides a tie-wire 16 into a folded wire channel 14 at the rim of the mouth 17 of the bag 13. A user just pulls out the endless tie-wire 16 from the opening 15 of the wire channel 14 to tie the mouth 12. But attaching an extra tie-wire 11 or 16 on the bag 10 or 13 will increase the production cost, and impedes continuous manufacturing process.

SUMMARY OF THE INVENTION

It is therefore an object of the present invention to provide a self-tied garbage bag provided with tie-strips which can be ruptured from the bag body for tightening up the mouth easily without any additional components attached thereon, so that this kind of plastic garbage bag can be manufactured in a continuous process.

According to the teaching of the present invention, the garbage bag includes a thermal bond strip extending along one or both lateral edges of the bag, and a tear line extending along the thermal bond strip. The tea line is a rupturable separation line which constitutes a tie-strip when ruptured from the thermal bond strip to the plastic garbage bag. In use, after the tie-strips are ruptured from the bag, their free ends are tied to close the opening (mouth) of the bag. Another thermal bond line is formed along the outer edge of the tear line to reinforce the strength of the tie-strip, or to form another tear line and a transverse thermal bond line outside the tie-strip to strength and double the length of the tie-strip.

It is important that the thermal bond strip, as well as tie-strips, extend not the full length of the garbage bag, but only partially thereby dividing the bag into upper part, middle part, and lower part. The middle part is narrower than the upper and the lower parts.

Preferably, the both ends of the thermal bond strip and the tie-strip have a sharp tip.

DETAILED DESCRIPTION OF THE PREFERRED EMBODIMENTS

Figure 1:
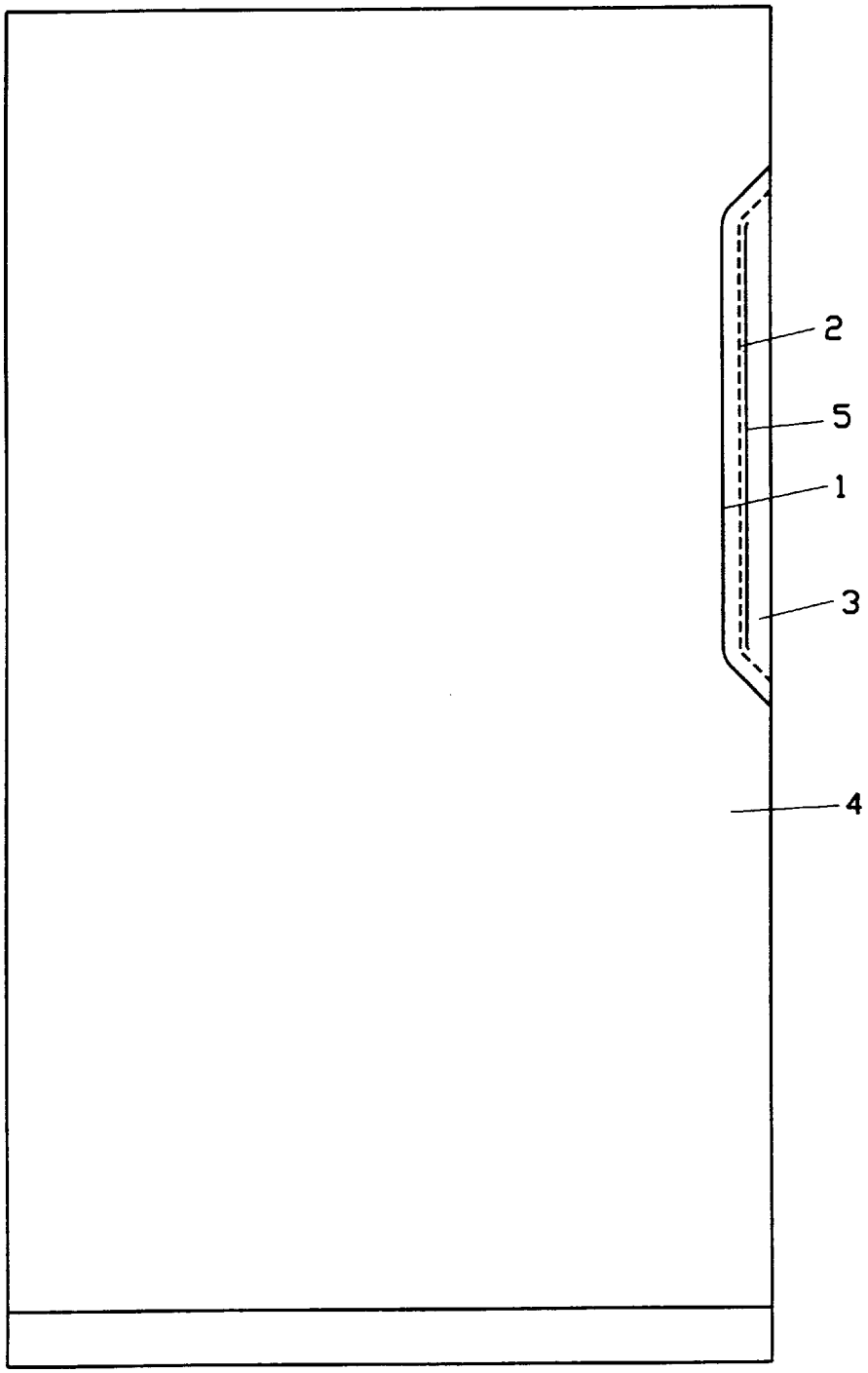
FIG. 1 is a front view of the garbage bag of the present invention.

Referring to FIG. 1, a flat mouth bag 4 has closed bottom and both sides, and can be manufactured as an individual bag or as a series of bags, arranged in roll with rupturable tear-lines.

The garbage bag has a front wall and a rear wall, which are united along their sides and a lower end, thereby forming a container for garbage. This container has a bottom, two lateral edges and a mouth (opening) contoured by upper ends of the front and rear walls.

A thermal bond line 1 extends along a portion of the lateral edges of the container between a lower point (spaced from the bottom of the container), and an upper point (spaced from the top of the container). The thermal bond strip is contoured by a thermal bond line 1, a portion of the lateral edge of the container, a lower point (spaced from the bottom of the container), and an upper point (spaced from the top of the container). A tear line 2, which is a rupturable separation line, extends along and within the thermal bond strip and separates it into two portions. By tearing off along the tear line 2, a tie-strip 3 is formed thereafter. A second thermal bond line 5 is formed along the outer edge of the tear line 2 which enhances the strength of the tie-strip 3.

Figure 2:
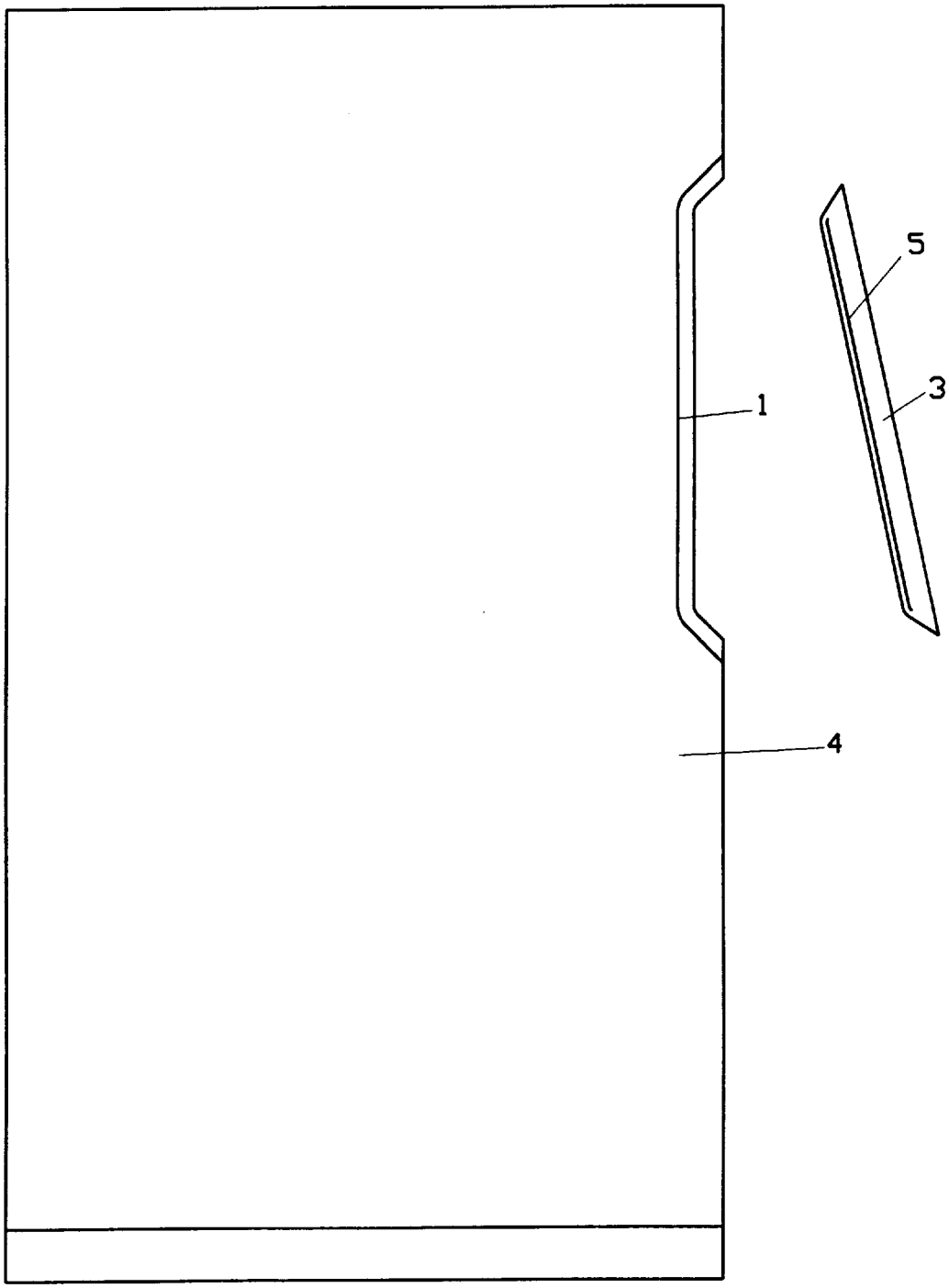
FIG. 2 is a front view of the garbage bag of the present invention, showing the tie-strips ruptured off the bag.
Figure 3:
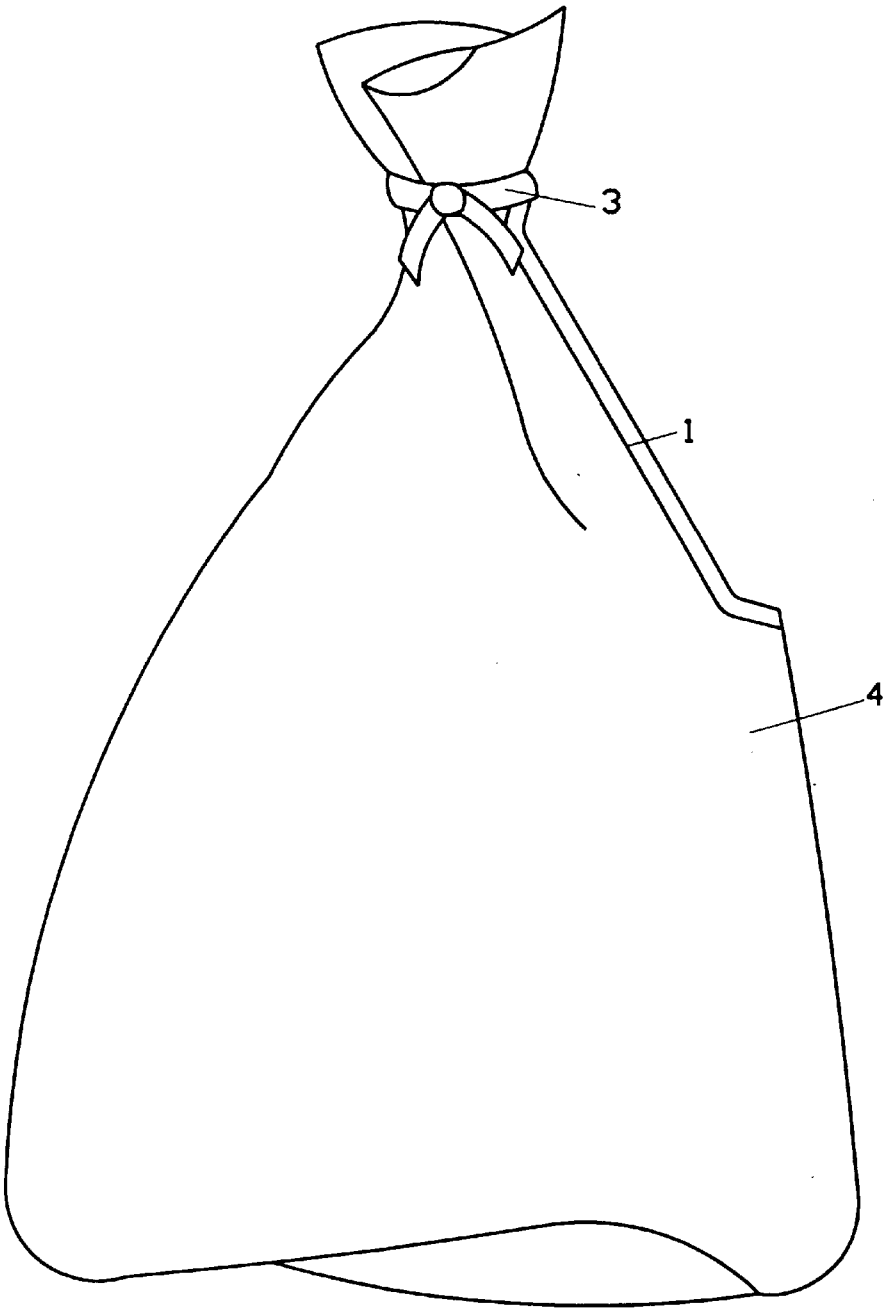
FIG. 3 shows the garbage bag of the present invention with the closed top.

Referring to FIG. 2, in use, a user fills objects or garbage into the bag 4, then tears away the tie-strip 3 along both sides starting from the lower points and respectively following the fine-hole rupturable tear-line 2 to the division portion so that the division portion of the tie-strip 3 connects the tie-strip 3 integrally with the bag body 4 close to the mouth. The second thermal bond line 5 forms a double strength of the tie-strip 3 to possesses a certain tensile strength. Then as shown in FIG. 3, to close the bag, the mouth is lifted up, the tie-strip 3 is wound around and tighten about the gripped neck of the mouth of the garbage bag.

Figure 4:
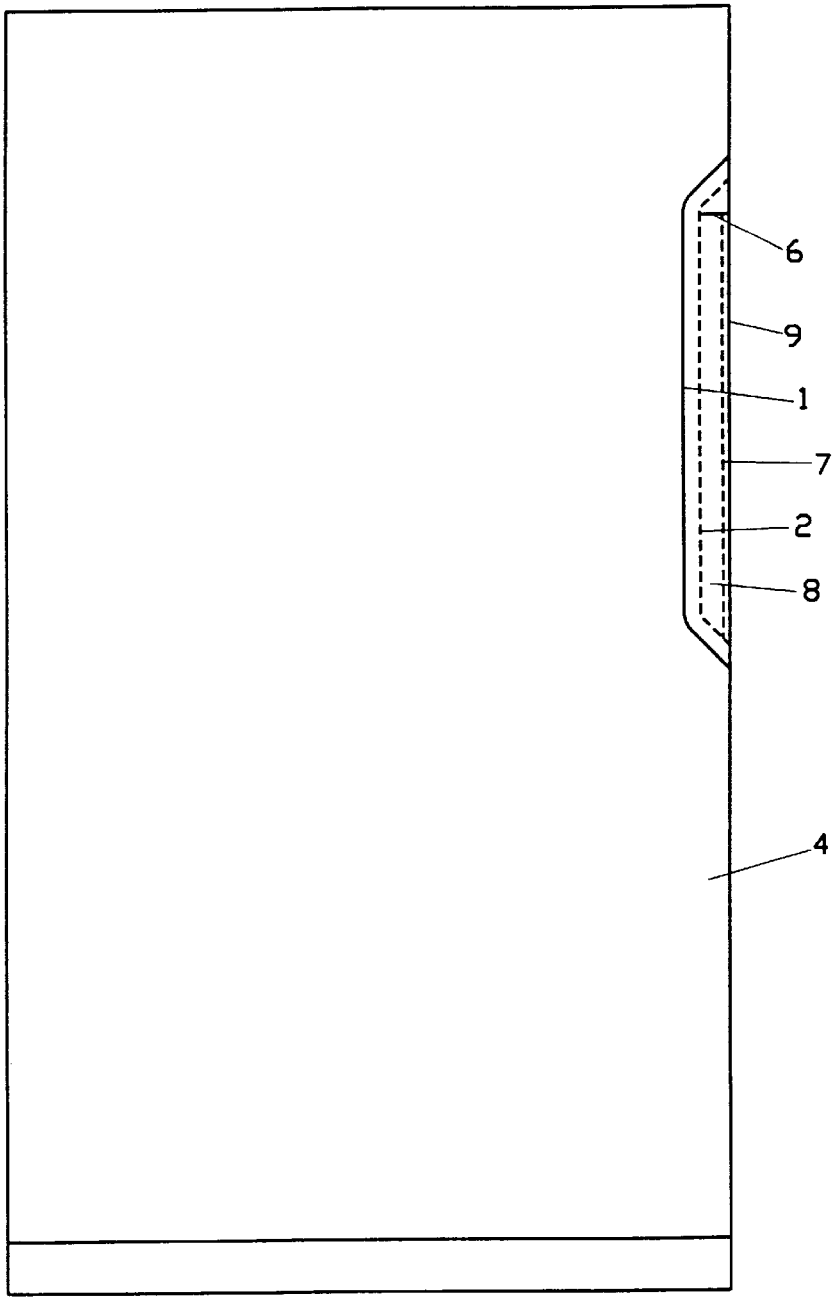
FIG. 4 is a front view showing another implementation of the bag of the present invention.
Figure 5:
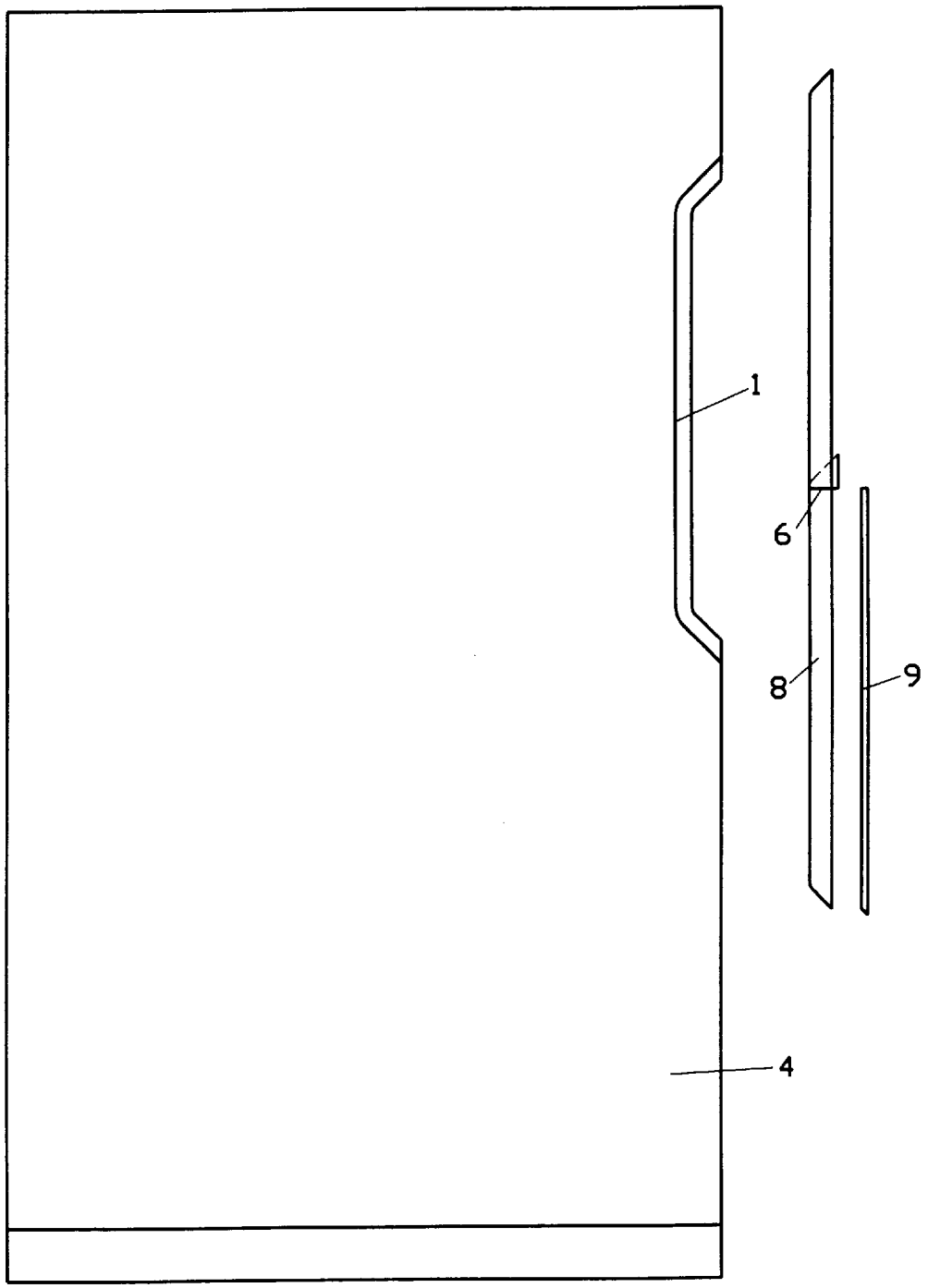
FIG. 5 is a from view of the garbage bag as shown in FIG. 4 showing the tie-strips ruptured off the bag.
Figure 6:
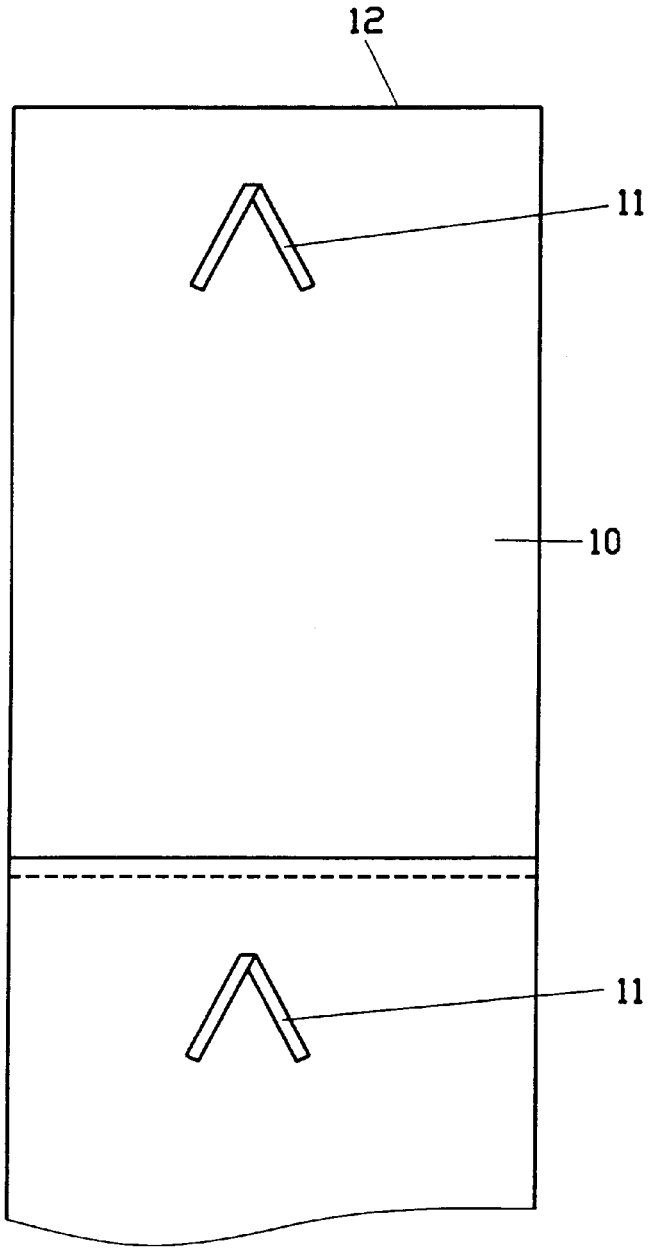
FIG. 6 (PRIOR ART)
FIG. 6, shows a garbage bag according to the prior art.
Figure 7:
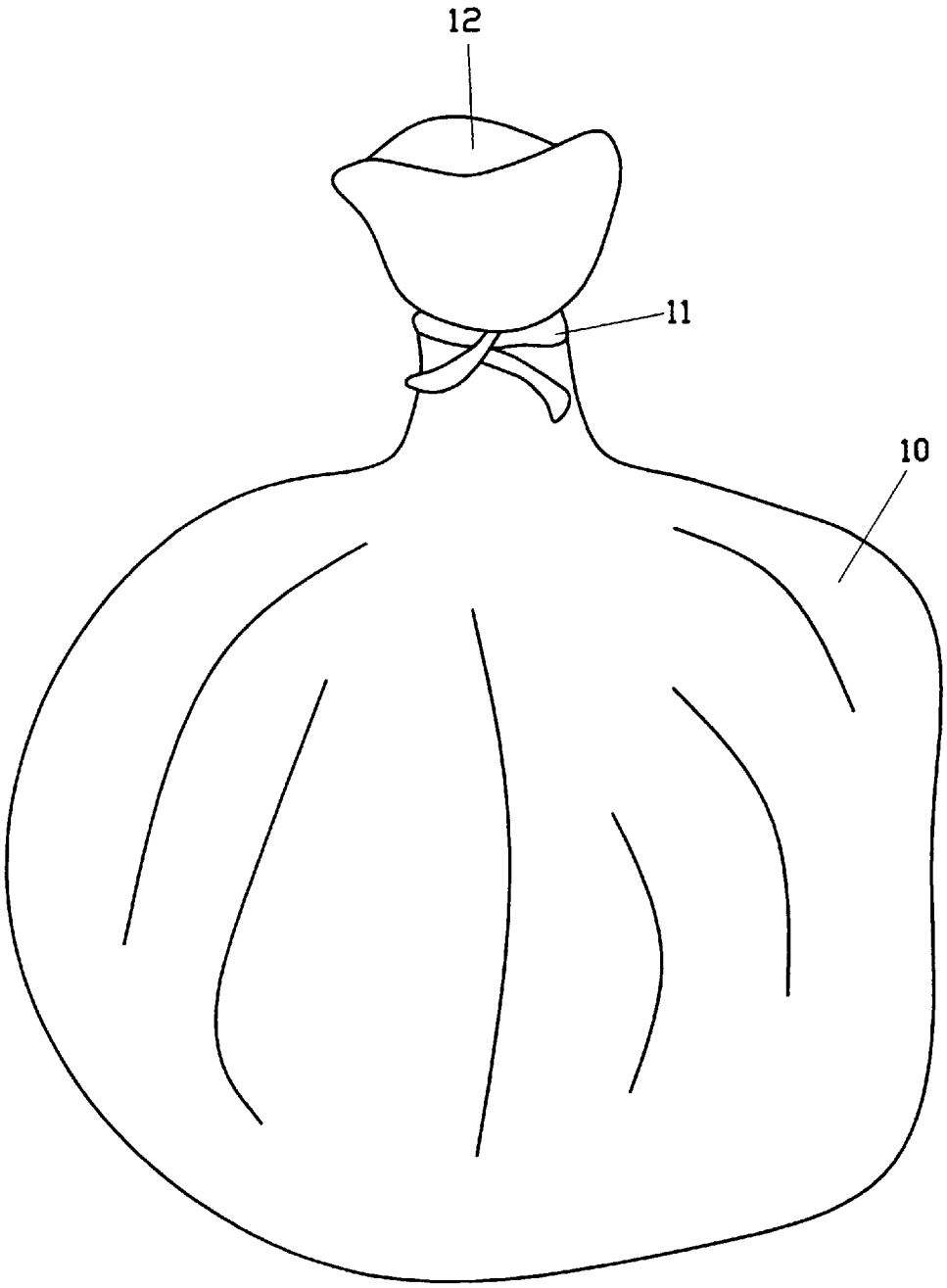
F I G . 7 (PRIOR ART)
FIG. 7 shows the garbage bag of FIG. 6 with the closed top.
Figure 8:
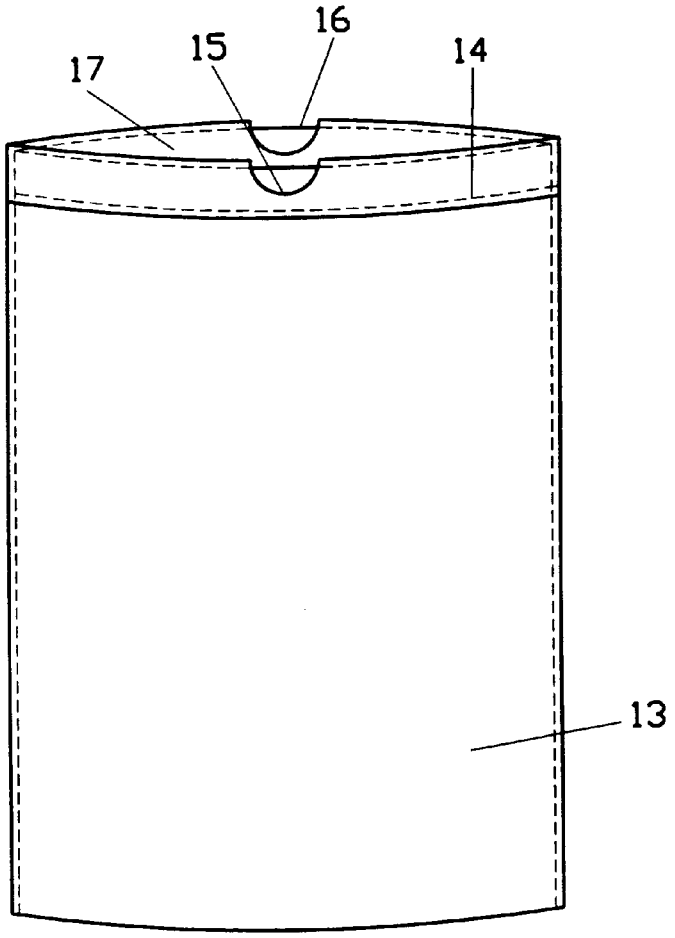
F I G . 8 (PRIOR ART)
FIG. 8 shows another prior art garbage bag.

In an alternate embodiment, as shown in FIG. 4, the tear line 2 may have its two ends extending to the side edges of the bag 4, so that when tearing off along the edge of the bag 4, the tie-strip 8 is separated from the bag 4, entirely. The tie-strip 8 is also composed of a second tear line 7 in a parallel direction, thus by tearing off portion 9 along the tear line 7 of the bag 4, as shown in FIG. 5, and again tearing off along the tie-strip 8, because of bond line 6, the tie-strip 8 has doubled its length.

Preferably, the both ends of the thermal bond strip 1 and the tie-strip 3 and 8 have a sharp tip.

I claim:

1. A self-tied garbage bag, comprising: an upper open end, a lower end, and sides forming a sealed container, and the improvements comprising:

said upper open end comprising at least a first bond line extending from and along at least one of a lateral edge of said container between a lower point and an upper point of said first bond line, said lower point of said first bond line being spaced from said bottom of said container, and said upper point of said first bond line being spaced from said top of said container, and a tear line extending along an outer edge of said bond line constituting a tie-strip, and a second bond line along of said tear line reinforcing said tie-strip.

2. A self-tied garbage bag, comprising: an upper open end, a lower end, and sides forming a sealed container, and the improvements comprising:

at least a first bond line formed at least at a lateral edge of said container extending between a lower point spaced from the bottom of said container and an upper point spaced from the top of said container, a first tear line extending within and along said first bond line from said lower point to said upper point of said first bond line constituting a tie-strip, said tie-strip comprising a second tear line extending along said lateral edge between said lower point and said upper point, and a second bond line formed transversely at one end of said tie-strip to permit a length of the tie-strip to be doubled when removed from the container along the first and second tear lines.

* * * * *